US007174816B1

(12) United States Patent
Di Bitonto et al.

(10) Patent No.: US 7,174,816 B1
(45) Date of Patent: Feb. 13, 2007

(54) VISUAL ALIGNMENT FEATURES FOR ADJUSTING TONGUE AND GROOVE PLIERS

(75) Inventors: Anthony Di Bitonto, Brooklyn, NY (US); John Thomas Jacobsen, Laguna Niguel, CA (US); Wilfrido Loor, Brooklyn, NY (US)

(73) Assignee: Helen of Troy Limited, Bridgetown (BB)

( * ) Notice: Subject to any disclaimer, the term of this patent is extended or adjusted under 35 U.S.C. 154(b) by 1 day.

(21) Appl. No.: 11/189,295

(22) Filed: Jul. 26, 2005

(51) Int. Cl.
*B25B 7/10* (2006.01)

(52) U.S. Cl. ..... 81/414; 81/407

(58) Field of Classification Search ..... 81/414, 81/407, 385, 318, DIG. 5; D8/23, 106
See application file for complete search history.

(56) References Cited

U.S. PATENT DOCUMENTS

| | | | | |
|---|---|---|---|---|
| 2,592,927 A | | 4/1952 | Manning | |
| 2,640,381 A | * | 6/1953 | Manning | 81/414 |
| 2,814,226 A | | 11/1957 | Lojczyc | |
| 2,882,775 A | * | 4/1959 | Rank et al. | 81/414 |
| 4,719,827 A | | 1/1988 | Igarashi | |
| 4,726,265 A | | 2/1988 | Reich | |
| 4,793,225 A | | 12/1988 | Berkich | |
| 4,901,609 A | | 2/1990 | Crum | |
| 5,134,908 A | | 8/1992 | Fisher | |
| 6,318,217 B1 | | 11/2001 | Emhardt et al. | |
| 2004/0020333 A1 | * | 2/2004 | Poole et al. | 81/411 |

* cited by examiner

*Primary Examiner*—David B. Thomas
(74) *Attorney, Agent, or Firm*—Greer, Burns & Crain, Ltd.

(57) ABSTRACT

Tongue and groove pliers include a first member having a slot, and a second member connected to the first member by a pin in the slot. The first member has a plurality of arcuate ribs defining open ended grooves on the side adjacent to the second member. The second member has a tongue on the side facing the first member. The tongue fits in a selected groove to adjust the spacing between opposing jaws on the respective first and second members. The pliers have at least one visual alignment feature to align the tongue with a desired groove. The alignment feature can be readily visible marks indicating locations of the tongue and/or grooves.

9 Claims, 2 Drawing Sheets

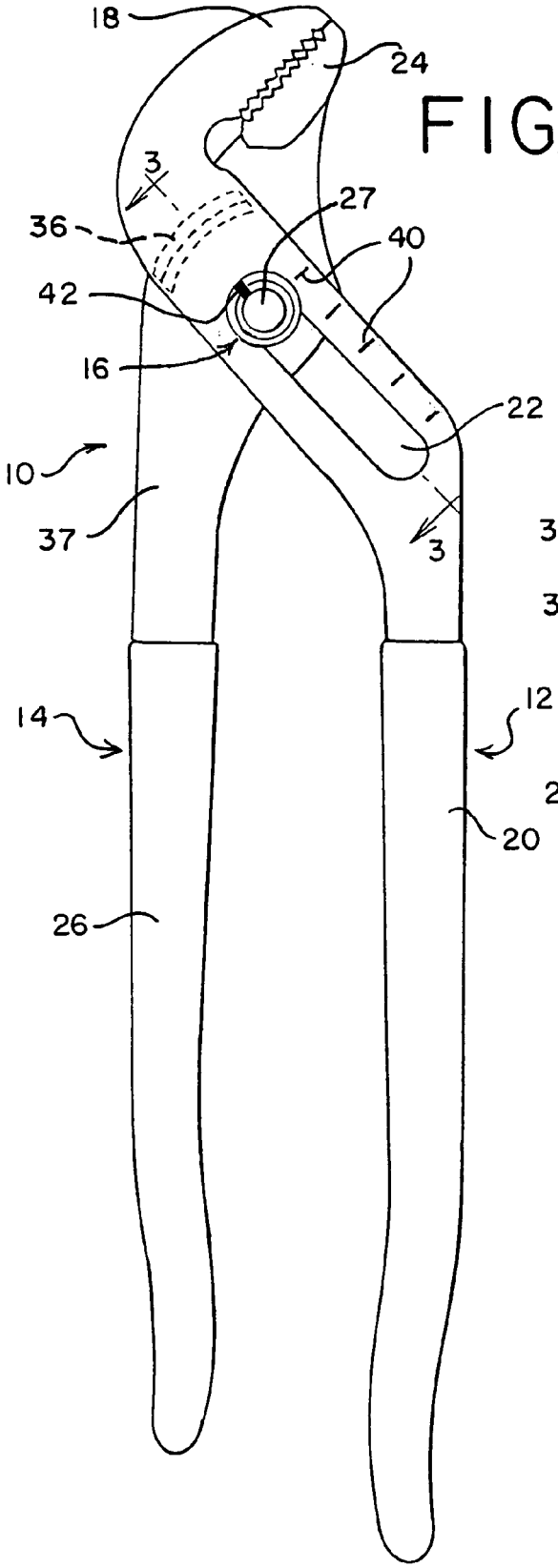
FIG. 1
FIG. 2
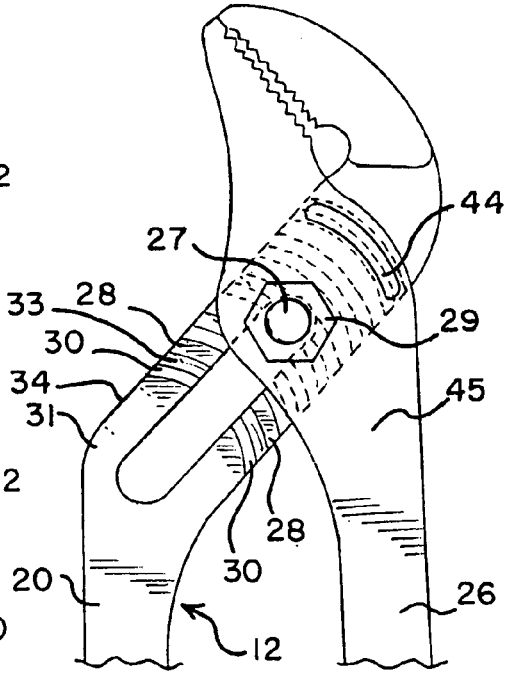
FIG. 3
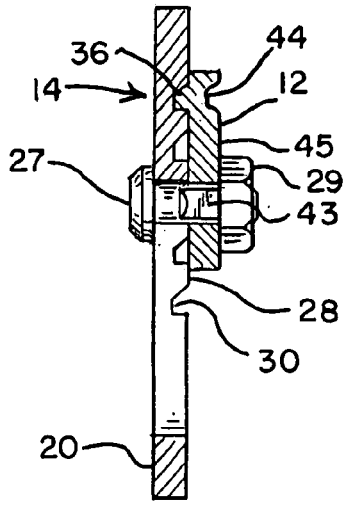

VISUAL ALIGNMENT FEATURES FOR ADJUSTING TONGUE AND GROOVE PLIERS

This invention relates to adjustable pliers having opposing members that can be visually aligned to adjust the plier jaws to a desired spacing.

BACKGROUND OF THE INVENTION

Conventional tongue and groove pliers have two opposing members. The first member has a jaw on one end, a handle on the other end, and an elongated slot therebetween. The second member also has a jaw on one end, and a handle on the other end. A pin opening is located between the second jaw and the second handle. A pin extends through the pin opening and the slot, and secures the first and second members for rotational movement, so that the jaws can be opened and closed by opening and closing the handles.

The first member has a plurality of arcuate ribs on the side adjacent the second member. The ribs are spaced to define a plurality of open-ended grooves. The second member has a tongue that fits in any selected groove, to adjust the minimum opening between the jaws when the handles are closed, and the spacing between the jaws as the handles are opened.

This adjustment feature makes tongue and groove pliers practical for many applications, but the tongue and grooves are substantially hidden between the members, making it difficult to align the tongue with a selected groove. Thus, there is a need for tongue and groove pliers having a visual aid for alignment of the tongue with a selected groove.

SUMMARY OF THE INVENTION

In keeping with one aspect of this invention, tongue and groove pliers include a first member having a slot, and a second member connected to the first member by a pin in the slot. The first member has a plurality of arcuate ribs defining a plurality of grooves on the side adjacent to the second member. The second member has a tongue on the side facing the first member. The tongue fits in a selected groove to adjust the spacing between opposing jaws on the respective first and second members. The pliers have at least one visual alignment feature to align the tongue with a desired groove. The alignment feature can include marks or other indicia on one or more outside surfaces indicating locations of the tongue and/or grooves, or the like.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which:

FIG. 1 is a top view of pliers made in accordance with one embodiment of the present invention, showing the jaws closed;

FIG. 2 is a partial view of the other side of the pliers of FIG. 1; and

FIG. 3 is a cutaway view of the pliers of FIG. 1, taken along lines 3—3 in FIG. 1.

DETAILED DESCRIPTION

Figure 4:
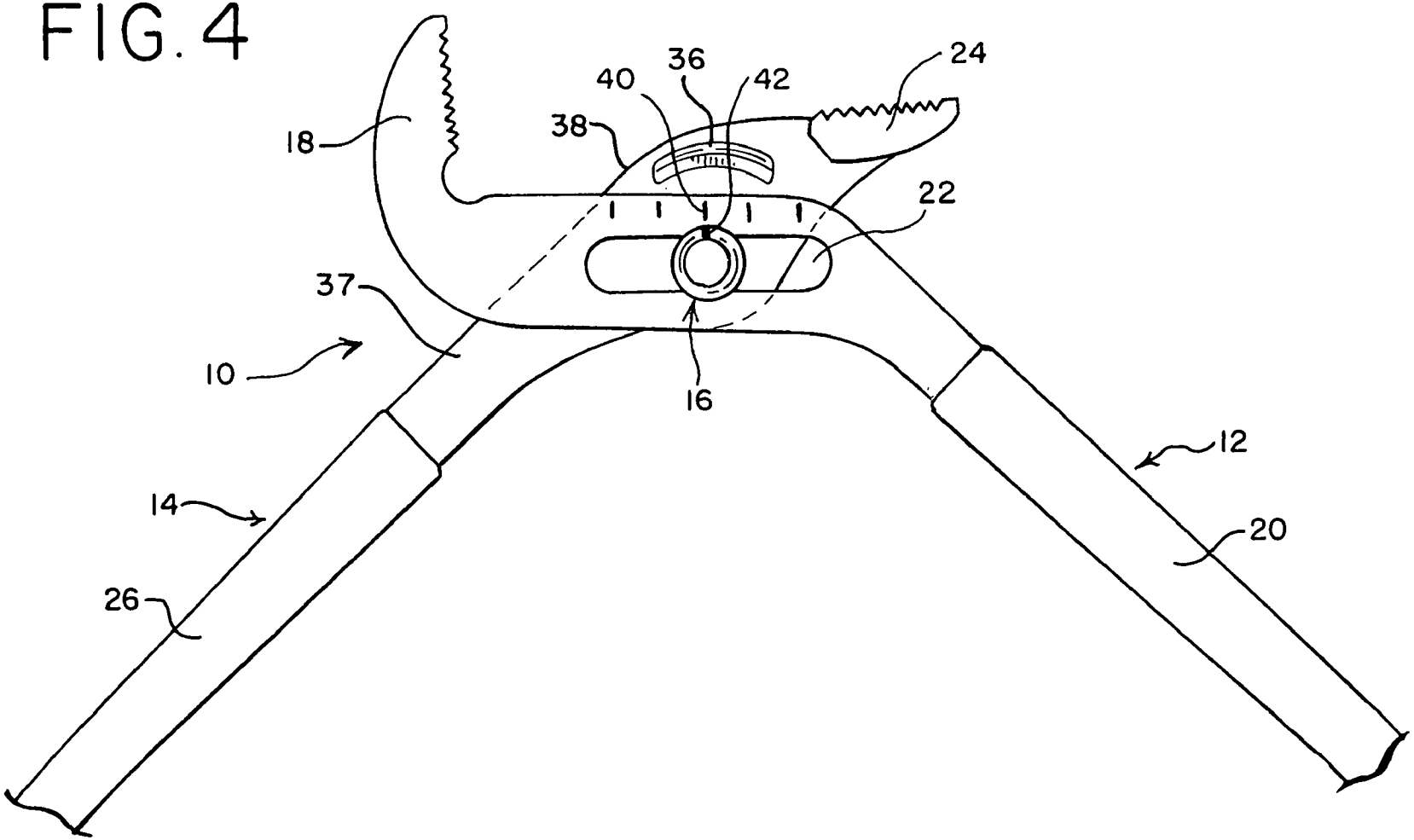
FIG. 4 is a partial top view of the pliers of FIG. 1, shown with the jaws open.

Referring to FIG. 1, tongue-and-groove pliers 10 include a first member 12, a second member 14 and a pin 16 which connects the first and second members for rotational movement with respect to each other.

The first member 12 has a jaw 18 on one end and a handle 20 on the other end. The member 12 also has an elongated slot 22 between the jaw 18 and the handle 20.

The second member 14 has a jaw 24 on one end and a handle 26 on the other end, separated by an opening (not shown) through which the pin 16 extends. Any suitable pin configuration can be used, such as a bolt 27 having a head larger than the opening, with a nut 29 larger than the width of the slot 22.

As seen in FIGS. 2 and 3, the first member 12 also has a plurality of spaced arcuate ribs 28 on a side 31 adjacent the second member 14, which ribs create corresponding grooves 30 between rib edges 33. Each groove 30 has an opening 32 along an edge 34. The other ends of the grooves can be open or closed.

The second member 14 has a tongue 36 (FIG. 4) on a side 37 extending close to an edge 38. The sides 31 (FIG. 4) and 37 (FIG. 1) are adjacent each other, so the tongue 36 and grooves 30 are not easily visible to the user at the same time. When the handles and jaws are wide open, as in FIG. 4, the tongue 36 does not engage any of the groove openings 32 (FIG. 2). In that condition, the pin 16 can be moved in the slot 22 to align the tongue 36 with a selected groove 30. As the handles are closed, the tongue 36 enters the selected groove 30, which fixes the positions of the first and second members with respect to each other, and determines how far, if at all, the jaws are separated from each other when the handles are fully closed.

In order to more easily align the tongue 36 with a desired groove opening 32, the member 12 can be provided with a plurality of marks or other indicia 40 on a side 41, which can be easily seen by the user and are not hidden from view, like the tongue and grooves. The marks 40 correspond to and identify the locations of the grooves, even though the marks 40 are not necessarily located directly over the grooves. The marks 40 can be etched, painted, forged, stamped or made in any other suitable manner. A mark 42 can be provided on the pin 16, as well. The mark 42 can also be easily viewed by the user.

In this example, the pin 16 is preferably keyed in the second member 14, so that the pin 16 accurately rotates with the second member 14. The pin 16 can be keyed by providing one or more flat sides 43 (FIG. 3), and corresponding flat surfaces in the opening in the member 14 through which the pin is located. With the jaws 18, 24 fully open, the mark 42 is generally aligned with the various marks 40 as the pin 16 slides through the slot 22.

An indentation 44 (FIG. 2) or other suitable indicia can also be provided on a side 45 of the member 14. The indentation 44 is easily viewed by the user. When the handles are fully open, at least some of the groove openings 32 can be seen, and the tongue 36 can more easily be aligned with a selected groove opening by simply aligning the indentation 44 with the selected groove opening. Of course, the indentation 44 is located so that the tongue 36 enters the selected groove opening 32 when the indentation 44 is generally aligned with the selected groove 30. The indentation is preferably shaped like the tongue and located directly opposite the tongue.

While the pliers just described include two separate visual alignment features, it is contemplated that the pliers could have only one alignment feature, such as the marks 40, 42 alone or the indentation 44 alone. It is also contemplated that the tongue 36 could be aligned with the marks 40, without using the mark 42.

Advantages of this invention are now apparent. The user can more easily adjust the pliers to a desired jaw spacing using the visual aids provided on one or both of the members 12, 14.

While the principles of the invention have been described above in connection with specific apparatus and applications, it is to be understood that this description is made only by way of example and not as a limitation on the scope of the invention.

What is claimed is:

1. Tongue and groove pliers comprising:

a first member having a first jaw on one end, a first handle on the other end, and a slot between the first jaw and the first handle;

a second member having a second jaw on one end, a second handle on the other end, and a pin opening between the second jaw and the second handle; the second member being connected to the first member by a pin extending through the pin opening and the slot;

the first member having a plurality of arcuate ribs on a side adjacent to the second member, the arcuate ribs defining a plurality of grooves, the second member having a tongue on the side facing the first member, wherein the tongue engages a selected groove when the handles are sufficiently closed, the tongue does not engage any of the grooves when the handles are sufficiently open, and the pin can be moved in the slot to align the tongue with a selected groove when the handles are sufficiently open, the pliers further having means for visually aligning the tongue with a desired groove when the handles are sufficiently open.

2. The pliers of claim 1, wherein the visual alignment means includes an indicator on a side of the second member opposite the tongue, the indicator being visually alignable with a selected groove when the handles are sufficiently open, the tongue entering the selected groove to which the indicator is generally aligned when the handles are sufficiently closed.

3. The pliers of claim 1, wherein the visual alignment means includes a plurality of first indicators on a side of the first member generally opposite the ribs, and a second indicator on the pin, the pin being keyed in the second member so that the second indicator can be aligned with a selected first indicator when the handles are sufficiently open, the tongue entering the groove to which the selected first indicator is aligned when the handles are sufficiently closed.

4. Tongue and groove pliers comprising:

a first member having a first jaw on one end, a first handle on the other end, and a slot between the first jaw and the first handle;

a second member having a second jaw on one end, a second handle on the other end, and a pin opening between the second jaw and the second handle; the second member being connected to the first member by a pin extending through the pin opening and the slot;

the first member having a plurality of arcuate ribs on a side adjacent to the second member, the arcuate ribs defining a plurality of grooves, the second member having a tongue on the side facing the first member, wherein the tongue engages a selected groove when the handles are sufficiently closed, the tongue does not engage any of the grooves when the handles are sufficiently open, and the pin can be moved in the slot to align the tongue with a selected groove when the handles are sufficiently open, the first member having a plurality of indicators on the side opposite the second member, wherein said indicators correspond to the grooves.

5. The pliers of claim 4 wherein the pliers are adjusted by aligning the tongue with an indicator corresponding to a selected groove.

6. The pliers of claim 4 wherein the pin is keyed in the pin opening, the pin having an indicator, wherein a groove is selected for engagement by the tongue by sufficiently opening the handles, aligning the indicator on the pin with the indicator on the first member corresponding to the selected groove, and closing the handles so that the tongue engages the selected groove.

7. Tongue and groove pliers comprising:

a first member having a first jaw on one end, a first handle on the other end, and a slot between the first jaw and the first handle;

a second member having a second jaw on one end, a second handle on the other end, and a pin opening between the second jaw and the second handle; the second member being connected to the first member by a pin extending through the pin opening and the slot;

the first member having a plurality of arcuate ribs on a side adjacent to the second member, the arcuate ribs defining a plurality of grooves, the second member having a tongue on the side facing the first member, wherein the tongue engages a selected groove when the handles are sufficiently closed, the tongue does not engage any of the grooves when the handles are sufficiently open, and the pin can be moved in the slot to align the tongue with a selected groove when the handles are sufficiently open, the second member further having an indicator on the side opposite the first member, the indicator being located generally opposite the tongue.

8. The plier of claim 7 where the indicator is an indentation.

9. The pliers of claim 8 where the indentation is shaped like the tongue.

* * * * *